US012268930B1

(12) United States Patent
Johnson

(10) Patent No.: US 12,268,930 B1
(45) Date of Patent: Apr. 8, 2025

(54) BODY MOTION OFFICE WORK PLATFORM

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 294 days.

(21) Appl. No.: 17/868,137

(22) Filed: Jul. 19, 2022

(51) Int. Cl.
*A63B 23/035* (2006.01)
*A63B 21/00* (2006.01)
*A63B 23/04* (2006.01)

(52) U.S. Cl.
CPC ..... *A63B 23/03533* (2013.01); *A63B 23/04* (2013.01); *A63B 21/4034* (2015.10); *A63B 21/4045* (2015.10)

(58) Field of Classification Search
CPC ..... A63B 21/4034; A63B 21/4045; A63B 23/03525; A63B 23/03533; A63B 23/04
See application file for complete search history.

(56) References Cited

U.S. PATENT DOCUMENTS 2,194,390 A 9/1879 Blend
2,772,881 A 12/1956 Jane
3,756,595 A 9/1973 Hague
3,970,302 A 7/1976 McFee
4,023,795 A 5/1977 Pauls
4,402,506 A 9/1983 Jones
4,434,981 A 3/1984 Norton
4,496,147 A 1/1985 DeCloux
4,529,194 A 7/1985 Haaheim
4,645,201 A 2/1987 Evans
4,659,077 A 4/1987 Stropkay
4,679,786 A 7/1987 Rodgers
4,709,918 A 12/1987 Grinblat
4,733,858 A 3/1988 Lan
4,850,585 A 7/1989 Dalebout
4,867,443 A 9/1989 Jensen
5,242,343 A 9/1993 Miller
5,267,923 A * 12/1993 Piaget ..... A63B 21/0085 482/52
5,299,993 A 4/1994 Habing
5,304,106 A * 4/1994 Gresko ..... A63B 22/0058 482/80
5,336,141 A 8/1994 Vittone
5,383,829 A 1/1995 Miller
(Continued)

FOREIGN PATENT DOCUMENTS

EP 3288427 3/2018

*Primary Examiner* — Gary D Urbiel Goldner
(74) *Attorney, Agent, or Firm* — Jeffrey D. Merrill; Kenneth C. Booth; Booth Udall Fuller, PLC

(57) ABSTRACT

A body motion platform with a base, a plurality of mechanical linkages coupled to the base, and a left footplate and a right footplate each linked to the base through the plurality of mechanical linkages. The plurality of mechanical linkages includes a vertical linkage and a horizontal linkage and is configured to maintain the left footplate and the right footplate in a horizontal orientation while moving each through a horizontal motion and a vertical motion. The vertical linkage is configured to control the vertical motion of the footplates and the horizontal linkage is configured to control the horizontal motion of the footplates. The horizontal motion and the vertical motion of each footplate are independent of each other. The horizontal motion and the vertical motion of the left footplate is reciprocally linked to the horizontal motion and the vertical motion of the right footplate, respectively.

18 Claims, 13 Drawing Sheets

(56) References Cited

U.S. PATENT DOCUMENTS 5,419,747 A 5/1995 Piaget et al.
5,496,235 A 3/1996 Stevens
5,540,637 A 7/1996 Rogers
5,575,740 A 11/1996 Piaget et al.
5,605,521 A 2/1997 Hsieh
5,735,773 A 4/1998 Vittone et al.
5,792,029 A 8/1998 Gordon
5,813,947 A 9/1998 Densmore
5,857,940 A 1/1999 Usted
5,971,892 A 10/1999 Lee
6,019,709 A 2/2000 Piaget
6,117,052 A 9/2000 Frost et al.
6,135,926 A 10/2000 Lee
6,206,806 B1 3/2001 Chu
6,224,516 B1 5/2001 Disch
6,302,830 B1 10/2001 Steams
6,595,899 B2 * 7/2003 Liang ..... A63B 22/0056 482/53
6,689,019 B2 2/2004 Ohrt
6,712,739 B1 * 3/2004 Chen ..... A63B 22/0058 482/53
6,875,160 B2 4/2005 Watterson
7,169,088 B2 1/2007 Rodgers
7,614,991 B2 11/2009 Fox
7,780,577 B2 8/2010 Arnold
7,780,578 B2 8/2010 Packham
7,833,134 B2 11/2010 Gordon
7,892,148 B1 2/2011 Stauffer et al.
7,901,332 B1 * 3/2011 Wen ..... A63B 22/205 482/52
7,951,050 B2 * 5/2011 Raumann ..... A61H 15/00 482/79
9,486,070 B2 11/2016 Labrosse et al.
9,498,671 B1 11/2016 Softky
9,511,254 B2 12/2016 Netter et al.
9,521,901 B2 12/2016 Dalebout
9,750,343 B2 9/2017 McBride
9,795,827 B2 10/2017 Wiener
9,925,403 B1 3/2018 Zarli
9,955,789 B2 5/2018 Herring et al.
10,046,197 B2 8/2018 Gordon
10,413,777 B2 9/2019 Hsieh
10,653,913 B2 * 5/2020 Yao ..... A63B 23/0405
10,668,323 B2 * 6/2020 Chang ..... F16H 19/04
11,173,344 B2 11/2021 Stehlik
2001/0036885 A1 * 11/2001 Castellot, Jr. ..... A63B 21/4015 482/79
2004/0162191 A1 8/2004 Ercanbrack et al.
2004/0176215 A1 9/2004 Gramaccioni
2005/0054492 A1 3/2005 Neff
2006/0046902 A1 3/2006 Chang
2006/0264306 A1 11/2006 Tischler et al.
2007/0270284 A1 * 11/2007 Lin ..... A63B 23/0429 482/52
2008/0026916 A1 * 1/2008 Chuang ..... A63B 22/0064 482/53
2008/0096745 A1 4/2008 Perry
2008/0214364 A1 9/2008 Maresh et al.
2008/0167164 A1 11/2008 Wang
2012/0088633 A1 4/2012 Crafton
2013/0085048 A1 * 4/2013 Na ..... A63B 23/0482 482/142
2014/0031175 A1 * 1/2014 Peralo ..... A63B 21/4045 482/66
2014/0073488 A1 3/2014 Wu
2014/0187383 A1 7/2014 Martin
2015/0250304 A1 9/2015 Dalebout
2016/0296791 A1 * 10/2016 Bailar ..... A63B 21/0087
2016/0325137 A1 * 11/2016 Bailar ..... A63B 21/068
2017/0113094 A1 * 4/2017 Bailar ..... A63B 22/203
2018/0015321 A1 * 1/2018 Ho ..... A63B 22/0664

* cited by examiner

BODY MOTION OFFICE WORK PLATFORM

TECHNICAL FIELD

Aspects of this document relate generally to body motion platforms, and more specifically to body motion platforms for office workers.

BACKGROUND

Some office workers, especially those employed in tech-related jobs like computer programming, computer aided design, or graphic arts, spend excessive amounts of time at a desk. Being seated for such long periods leads to a variety of health-related problems, including back pain, weight gain, loss of muscle tone, and poor circulation. For this reason, standing desks have recently become popular. However, standing in one spot for long periods of time isn't much healthier than sitting, and creates its own set of health problems. The negative effects of sitting and standing can only be overcome through increased activity of your body's muscles and joints.

SUMMARY

Aspects of this document relate to a body motion office work platform comprising a base configured to sit on a surface and stabilize the body motion office work platform, a plurality of mechanical linkages coupled to the base including a horizontal linkage, and a left footplate and a right footplate each linked to the base through the plurality of mechanical linkages, wherein the plurality of mechanical linkages is configured to move each of the left footplate and the right footplate through a horizontal motion with respect to the base, wherein the horizontal linkage is configured to control the horizontal motion of the left footplate and the right footplate and is biased towards a horizontal neutral position in which the left footplate and the right footplate are positioned equidistant from a plane extending upward from a front of the base, and wherein the horizontal motion of the left footplate is reciprocally linked to the horizontal motion of the right footplate.

Particular embodiments may comprise one or more of the following features. The plurality of mechanical linkages may be configured to move each of the left footplate and the right footplate through a vertical motion with respect to the base. The horizontal motion and the vertical motion of the left footplate may be independent of each other, and the horizontal motion and the vertical motion of the right footplate are independent of each other. The vertical motion of the left footplate may be reciprocally linked to the vertical motion of the right footplate. The plurality of mechanical linkages may further include a vertical linkage configured to control the vertical motion of the left footplate and the right footplate and wherein the vertical linkage is biased towards a vertical neutral position in which the left footplate and the right footplate are positioned equidistant from the surface. When the left footplate and the right footplate are in an aligned position in which the left footplate and the right footplate are positioned equidistant from the horizontal surface, the plurality of mechanical linkages may be contained below the left footplate and the right footplate. The horizontal linkage may be biased towards the horizontal neutral position by a set of biasing elements. A seat adjustably coupled to the base and configured to allow a user to operate the body motion office work platform while seated. The left footplate and the right footplate may be each sized to simultaneously fit both feet of a user.

Aspects of the disclosure relate to a body motion office work platform comprising a base configured to sit on a surface and stabilize the body motion office work platform, a plurality of mechanical linkages coupled to the base, and a left footplate and a right footplate each linked to the base through the plurality of mechanical linkages, wherein the plurality of mechanical linkages is configured to move each of the left footplate and the right footplate through a horizontal motion and a vertical motion with respect to the base, wherein the horizontal motion and the vertical motion of the left footplate are independent of each other, and the horizontal motion and the vertical motion of the right footplate are independent of each other, and wherein the horizontal motion of the left footplate is reciprocally linked to the horizontal motion of the right footplate and the vertical motion of the left footplate is reciprocally linked to the vertical motion of the right footplate.

Particular embodiments may comprise one or more of the following features. The plurality of mechanical linkages may include a vertical linkage configured to control the vertical motion of the left footplate and the right footplate and a horizontal linkage configured to control the horizontal motion of the left footplate and the right footplate. The vertical linkage may be biased towards a vertical neutral position in which the left footplate and the right footplate are positioned equidistant from the horizontal surface and the horizontal linkage is biased towards a horizontal neutral position in which the left footplate and the right footplate are positioned equidistant from a plane extending up from a front of the base. A seat adjustably coupled to the base and configured to allow a user to operate the body motion office work platform while seated. The left footplate and the right footplate may each be sized to simultaneously fit both feet of a user.

Aspects of the disclosure relate to a body motion office work platform comprising a base configured to sit on a surface and stabilize the body motion office work platform, a plurality of mechanical linkages coupled to the base, and a left footplate and a right footplate each linked to the base through the plurality of mechanical linkages, wherein the left footplate and the right footplate are each sized to simultaneously fit both feet of a user, and wherein the plurality of mechanical linkages is configured to move each of the left footplate and the right footplate through a horizontal motion with respect to the base.

Particular embodiments may comprise one or more of the following features. When the left footplate and the right footplate are in an aligned position in which the left footplate and the right footplate are positioned equidistant from the horizontal surface, the plurality of mechanical linkages may be contained below the left footplate and the right footplate. The plurality of mechanical linkages may include a horizontal linkage configured to control the horizontal motion of the left footplate and the right footplate and wherein the horizontal linkage is biased towards a horizontal neutral position in which the left footplate and the right footplate are positioned equidistant from a plane extending up from a front of the base. A seat adjustably coupled to the base and configured to allow a user to operate the body motion office work platform while seated. The horizontal motion of the left footplate may be reciprocally linked to the horizontal motion of the right footplate. The plurality of mechanical linkages may be configured to move each of the left footplate and the right footplate through a vertical motion with respect to the base.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

DETAILED DESCRIPTION

Figure 1:
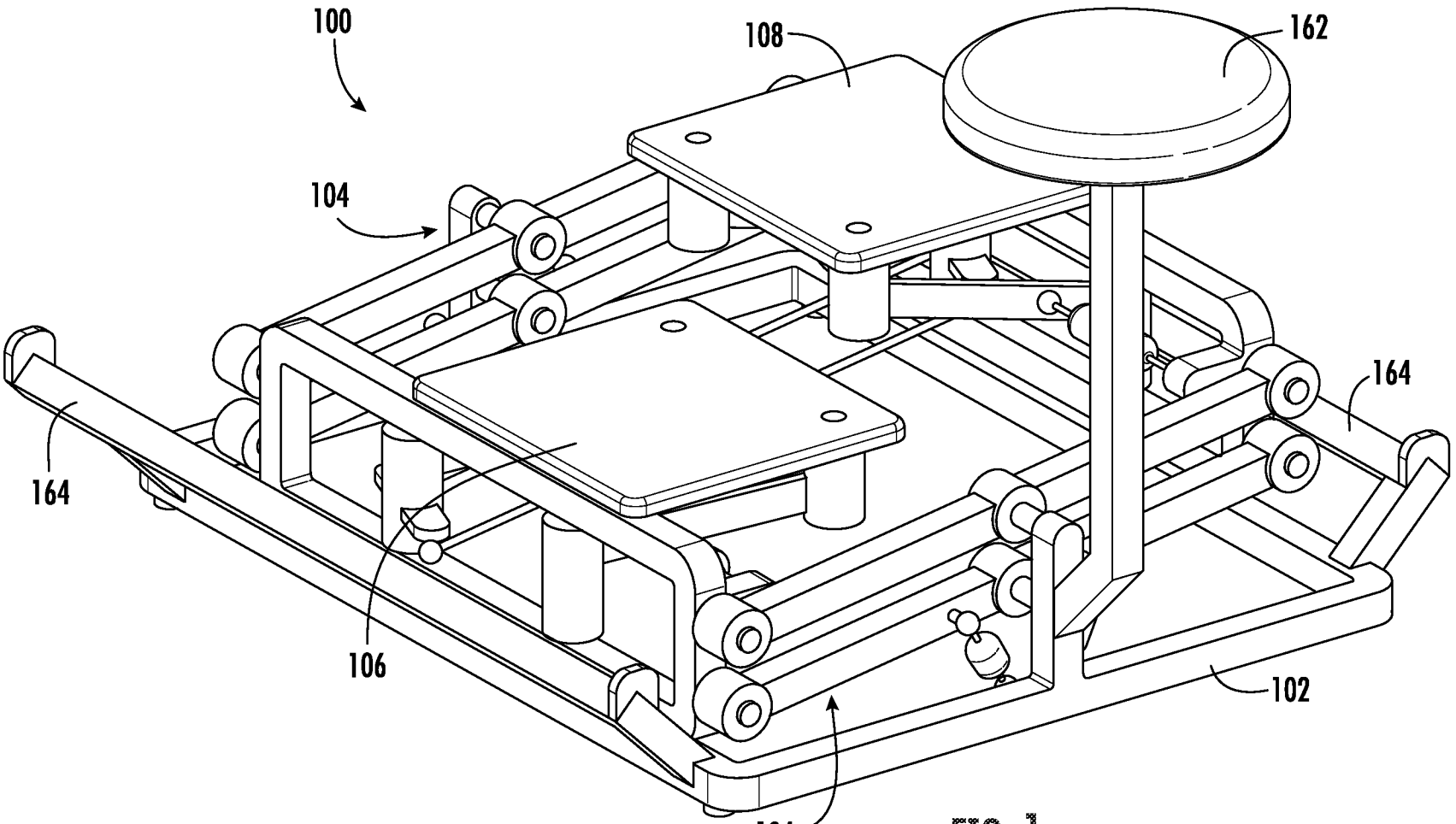
FIG. 1 is a perspective view of a body motion office work platform.
Figure 2:
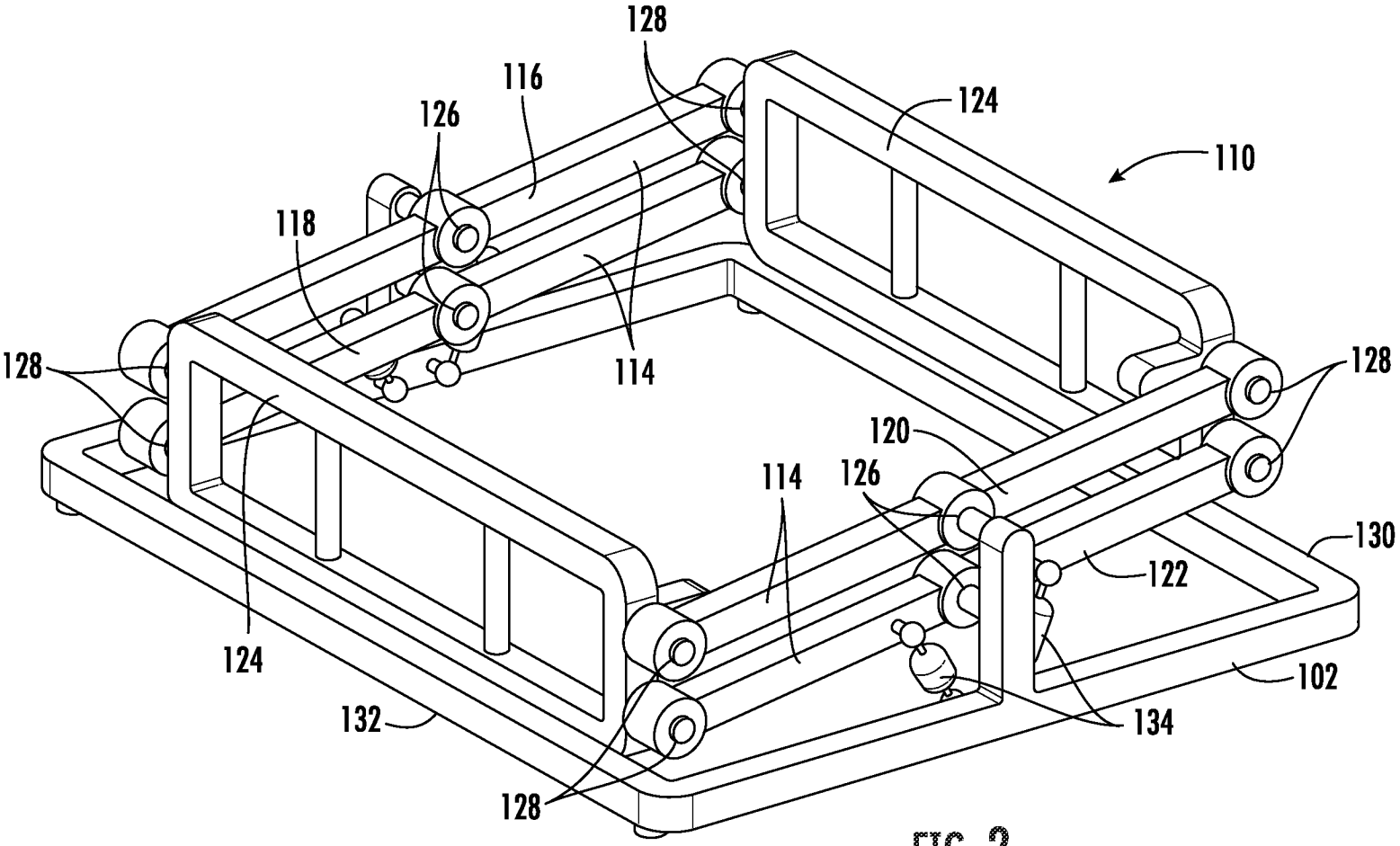
FIG. 2 is a perspective view of the base of the body motion office work platform shown in FIG. 1 supporting the vertical linkage.
Figure 3:
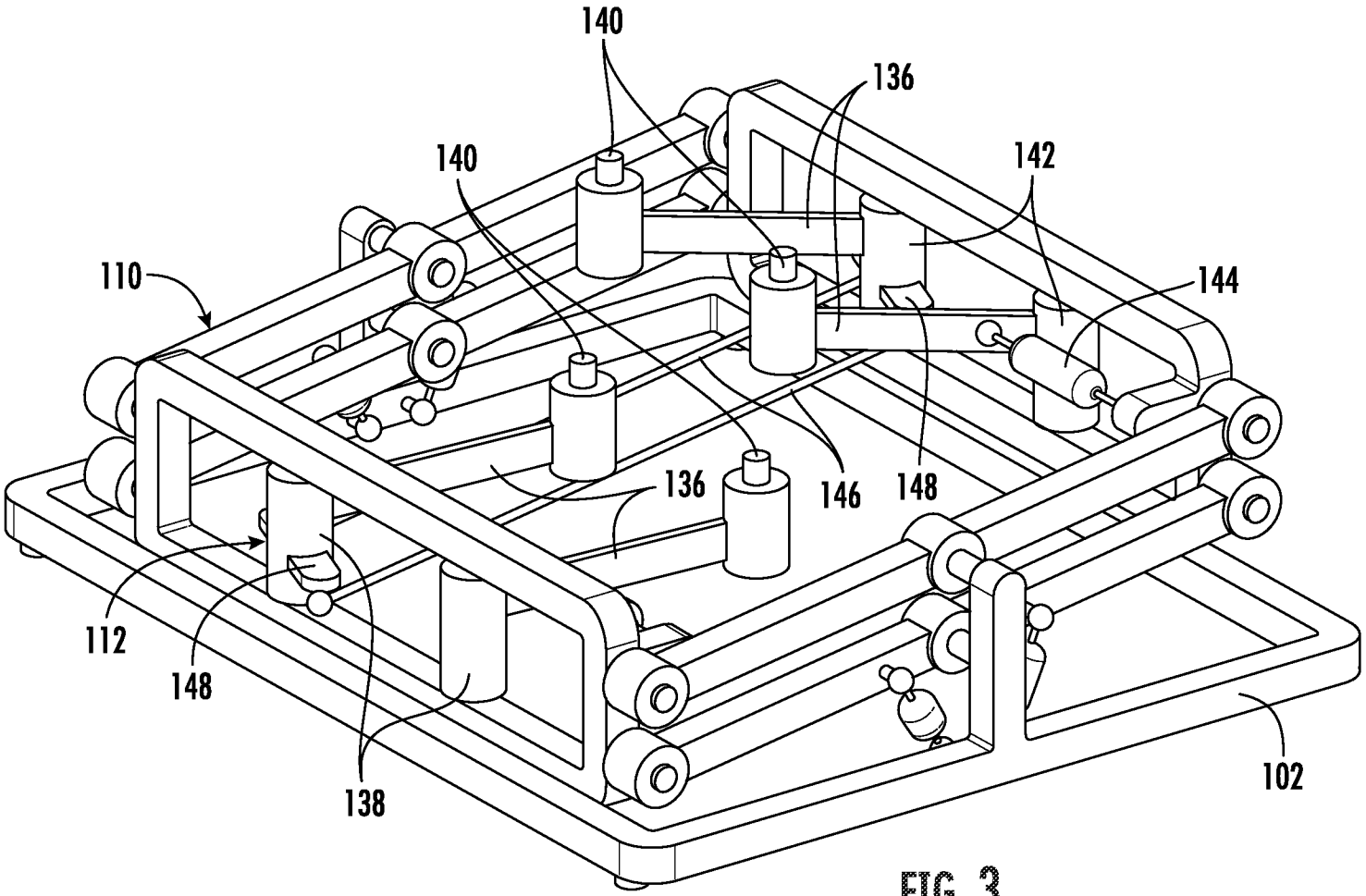
FIG. 3 is a perspective view of the base of the body motion office work platform shown in FIG. 1 supporting the vertical linkage and the horizontal linkage.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to a body motion office work platform 100. The platform 100 is configured to improve the physical wellbeing of a user by helping the user to move the user's body through various motions while the user stands or sits at a desk. By increasing the activity of the user's muscles and joints, the platform 100 helps prevent the health-related problems that are frequently experienced by office workers.

As shown in FIG. 1, the platform 100 may comprise a base 102, a plurality of mechanical linkages 104 coupled to the base 102, and a left footplate 106 and a right footplate 108 each linked to the base 102 through the plurality of mechanical linkages 104. The base 102 is configured to sit on a surface and stabilize the platform 100. Generally, the surface will be horizontal or nearly horizontal. The base 102 is therefore sized to provide stability, with a larger size of the base 102 being associated with increased stability for the platform 100. The plurality of mechanical linkages 104 may be configured to maintain each of the left footplate 106 and the right footplate 108 in a horizontal orientation, or in an orientation parallel with the surface on which the base 102 sits. A footplate 106, 108 that is in the horizontal orientation may be completely horizontal, with the footplate 106, 108 parallel with the horizontal surface on which the base 102 sits. A footplate that is in the horizontal orientation may also be angled in any direction by as much as 5 degrees, 15 degrees, or 25 degrees. For the purposes of this disclosure, any angle is still considered a horizontal orientation as long as the footplates 106, 108 do not interfere with the use of the platform 100 due to the user slipping or falling off of the platform 100.

The left footplate 106 and the right footplate 108 are configured as surfaces to support the user on the platform 100. Each of the left footplate 106 and the right footplate 108 may be sized to simultaneously fit both feet of a user. In other words, each of the left footplate 106 and the right footplate 108 may be big enough that a user can stand with both feet on one of the left footplate 106 or the right footplate 108. This facilitates mounting the platform 100 because the user can step onto one footplate with both feet, then move one of the feet onto the other footplate. Additionally, even when the user has one foot on the left footplate 106 and the other foot on the right footplate 108, the larger size of the footplates allows the user to easily reposition their feet as needed, whether for comfort or to perform the small lateral foot movements inherent to the performance of desk work.

The plurality of mechanical linkages 104 are also configured to move each of the left footplate 106 and the right footplate 108 through a horizontal motion and/or a vertical motion with respect to the base 102. Thus, in some embodiments, the plurality of mechanical linkages 104 are configured to move each of the left footplate 106 and the right footplate 108 through a horizontal motion, in other embodiments, the plurality of mechanical linkages 104 are configured to move each of the left footplate 106 and the right footplate 108 through a vertical motion, and in other embodiments, the plurality of mechanical linkages 104 are configured to move each of the left footplate 106 and the right footplate 108 through a horizontal motion and a vertical motion. The horizontal motion and the vertical motion of the left footplate 106 are respectively related to but distinct from the horizontal motion and the vertical motion of the right footplate 108. In other words, the horizontal motion of the left footplate 106 is related to but not the same as the horizontal motion of the right footplate 108 and the vertical motion of the left footplate 106 is related to but not the same as the vertical motion of the right footplate 108. The relationships between the horizontal motions of each footplate 106, 108 and the vertical motions of each footplate 106, 108 are described in more detail below.

The plurality of mechanical linkages 104 may include a vertical linkage 110 and a horizontal linkage 112, with "vertical" and "horizontal" referring to the type of motion controlled by each linkage. Thus, the vertical linkage 110 may be configured to control the vertical motion of the left footplate 106 and the right footplate 108. As shown in FIGS. 1-4, in some embodiments, the vertical linkage 110 comprises a plurality of tilt arms 114 including an upper front tilt arm 116, a lower front tilt arm 118, an upper back tilt arm 120, and a lower back tilt arm 122, and at least two side frames 124. As shown, each of the tilt arms 114 is pivotally coupled to the base 102. Additionally, each of the tilt arms 114 may be coupled to the base 102 at a center 126 of the respective tilt arm 114.

Figure 4:
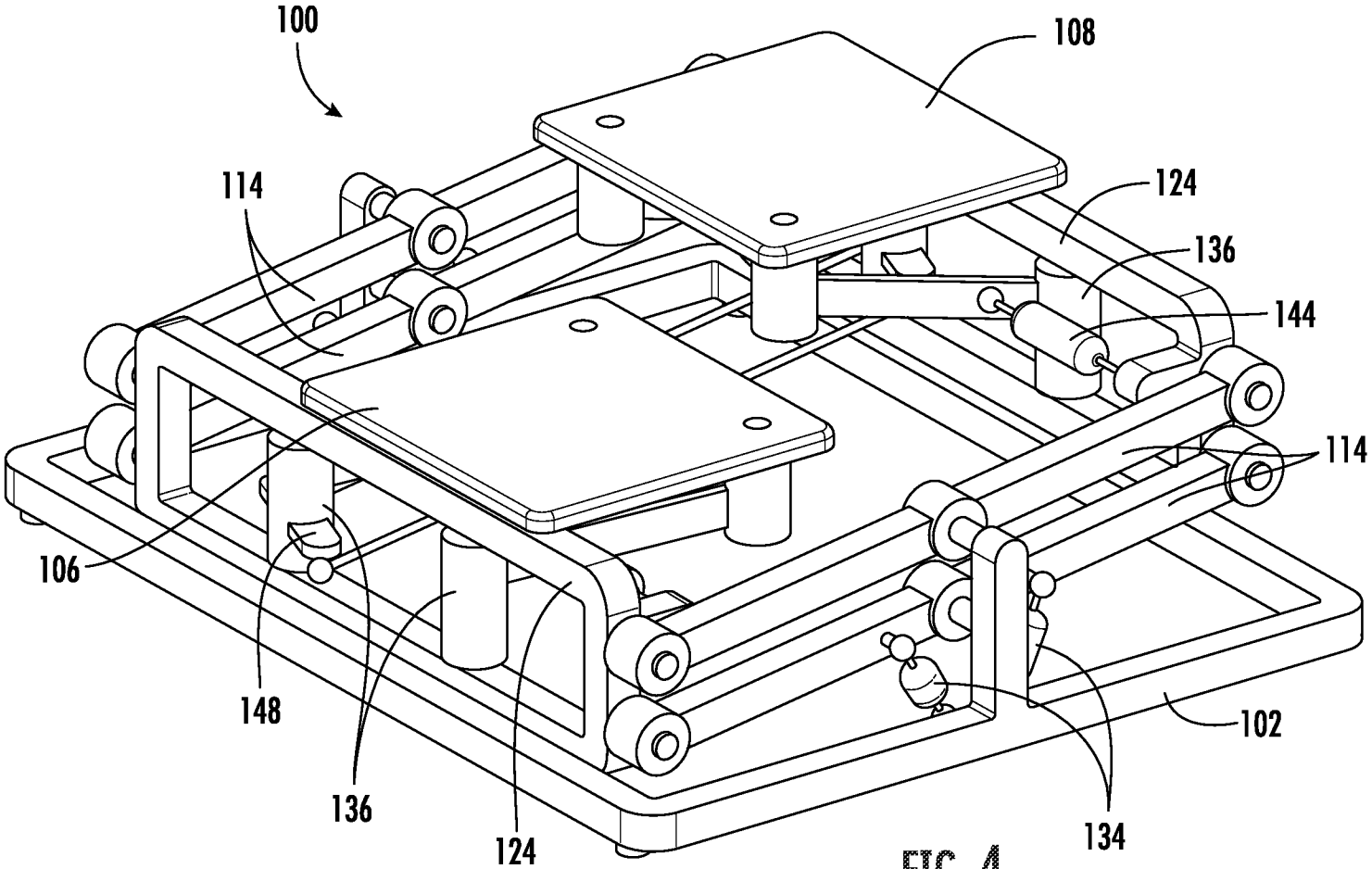
FIG. 4 is a perspective view of the components shown in FIG. 3 with the left and right footplates installed on the horizontal linkage.
Figure 9:
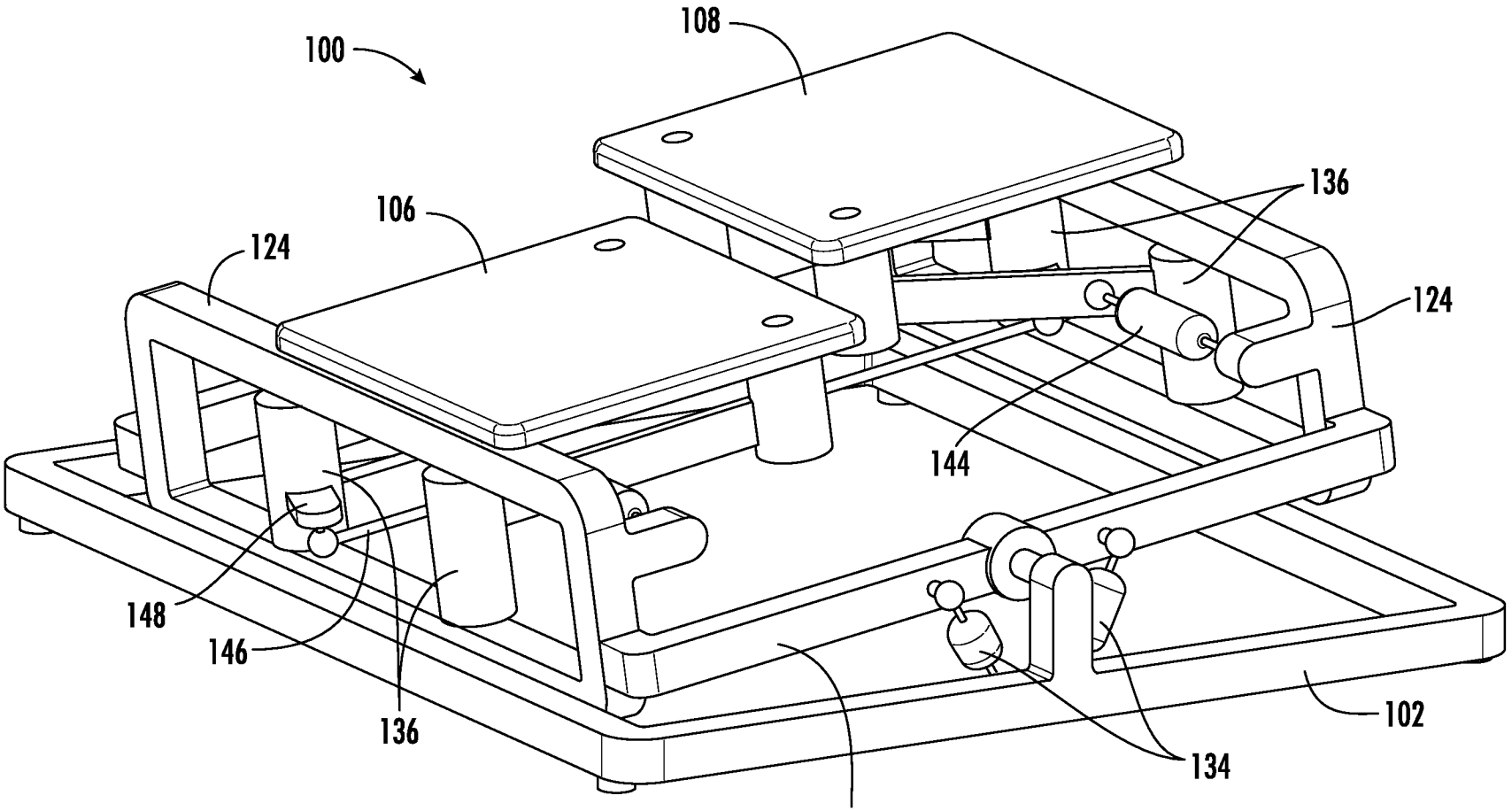
FIG. 9 is a perspective view of another embodiment of the body motion office work platform.

Each endpoint 128 of the tilt arms 114 may be coupled to one of at least two side frames 124. As shown in FIG. 4, the endpoints 128 may be pivotally coupled to one of the side frames 124. For example, the endpoints 128 of the tilt arms 114 that are positioned on a right side 130 of the base 102 may be joined to a first of the at least two side frames 124, and the endpoints 128 of the tilt arms 114 that are positioned on a left side 132 of the base 102 may be joined to a second of the at least two side frames 124. This unifies the motion of each of the tilt arms 114 as they rotate about the centers 126 of the tilt arms 114, with all of the endpoints 128 positioned on the right side 130 of the base 102 moving up or down together, and all of the endpoints 128 positioned on the left side 130 of the base 102 moving up or down together. Each of the tilt arms 114 may be the same length. Thus, when the tilt arms 114 rotate about the centers 126 of the tilt arms 114 through the same angles, the endpoints 128 of the tilt arms 114 move together, maintaining the angles and distances between each endpoint 128, due to the parallelogram structure of the vertical linkage 110. This causes the orientation of the side frames 124 to remain generally the same throughout the rotation of the tilt arms 114. In some embodiments, such as is shown in FIG. 9, the plurality of tilt arms 114 may be fixedly coupled to the side frames 124 at the endpoints 128 of the tilt arms 114, rather than being pivotally coupled. In such an embodiment, the orientation of the side frames 124 changes as the tilt arms 114 are rotated.

Figure 5:
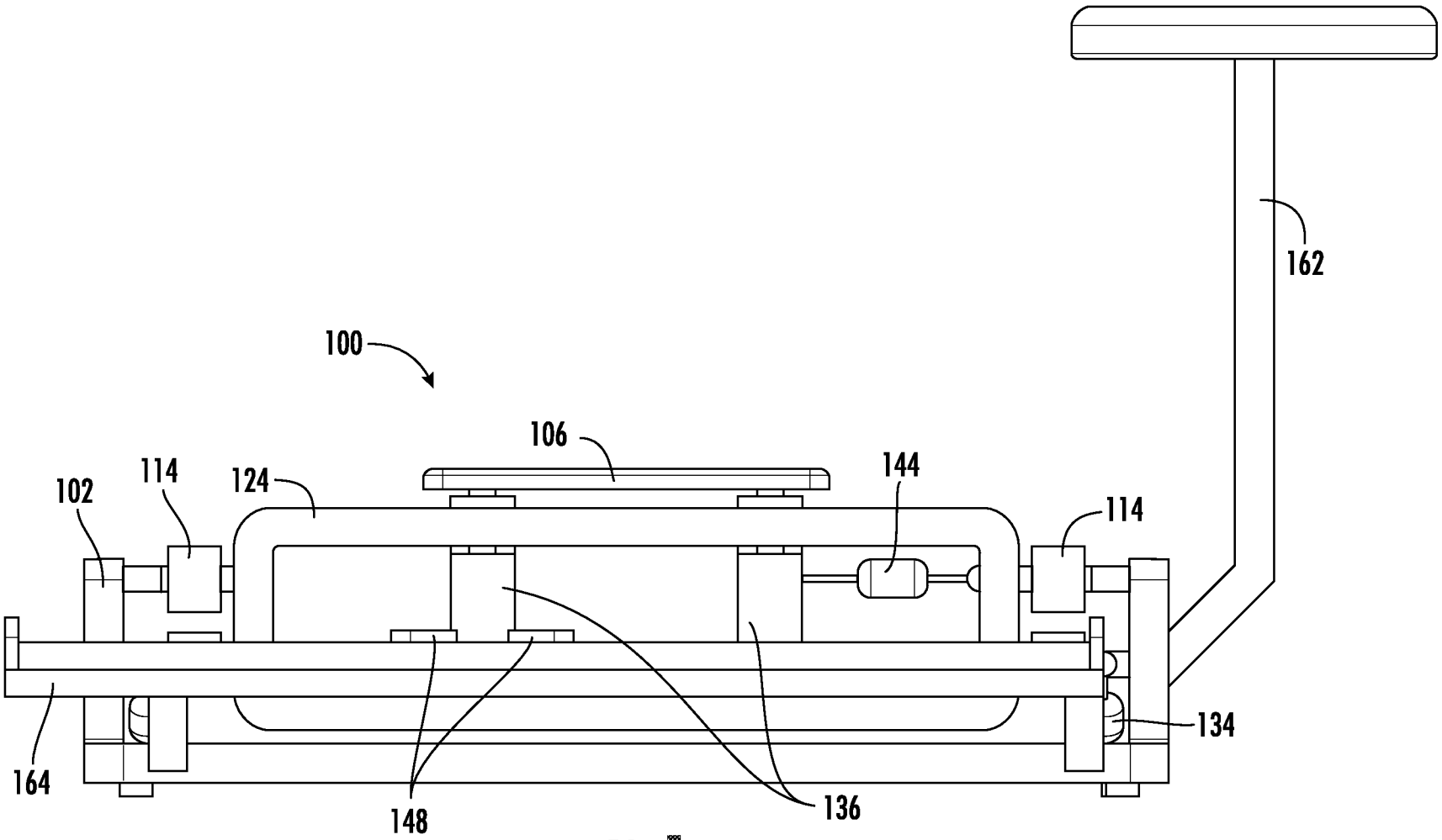
FIG. 5 is a side view of the body motion office work platform shown in FIG. 1 in the vertical neutral position.
Figure 6:
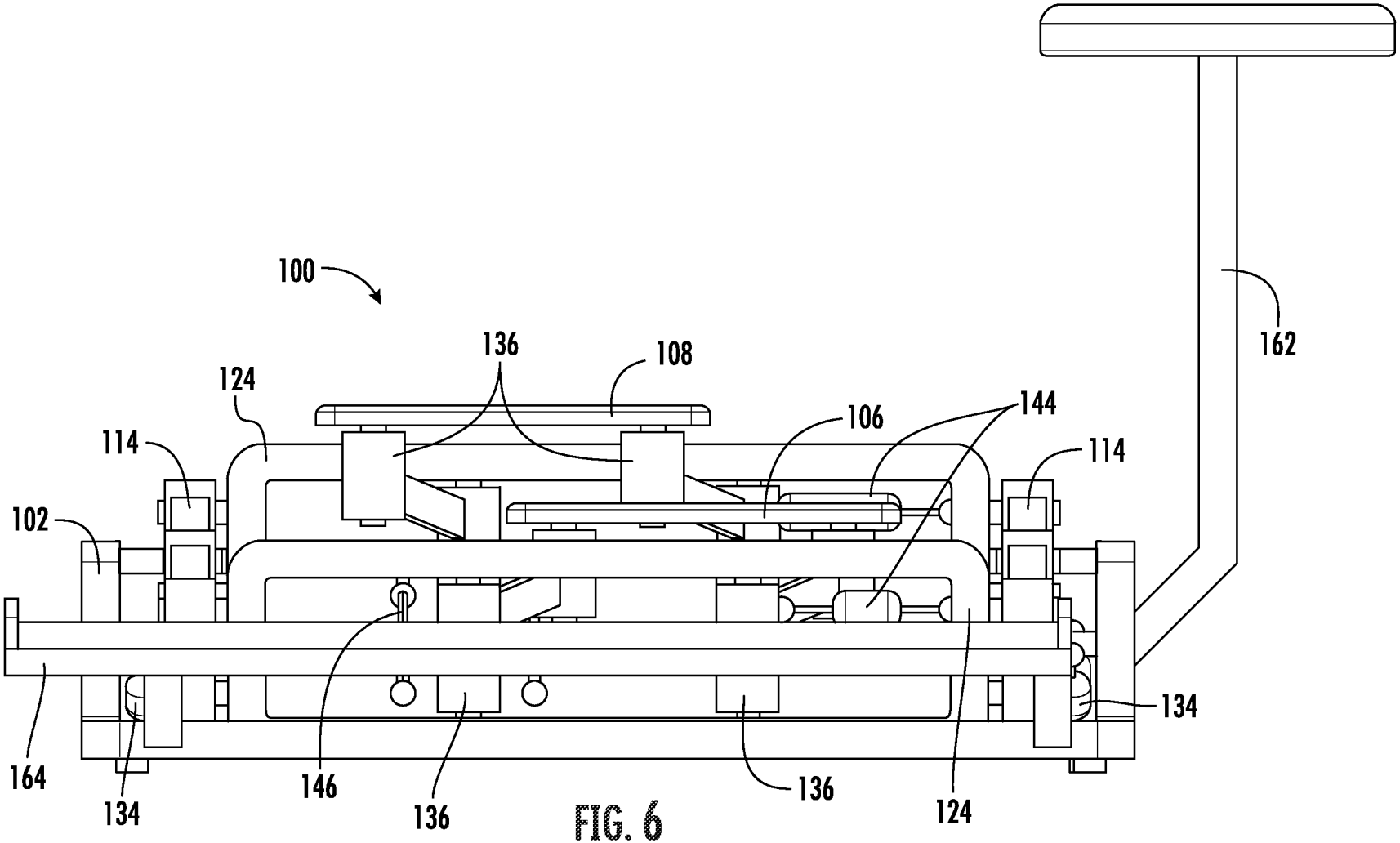
FIG. 6 is a side view of the body motion office work platform shown in FIG. 1 moved out of the vertical neutral position.

The vertical linkage 110 may be biased towards a vertical neutral position. When the vertical linkage 110 is in the vertical neutral position, the left footplate 106 and the right footplate 108 are positioned equidistant from the horizontal surface on which the base 102 sits, as shown in FIG. 5. In other words, the left footplate 106 and the right footplate 108 are at the same height when the vertical linkage 110 is in the vertical neutral position. Thus, the left footplate 106 and the right footplate 108 may be vertically self-centering. A vertical biasing element 134 may be affixed to the vertical linkage 110 and to the base 102 to provide the bias towards the vertical neutral position. The vertical biasing element 134 may be a spring, a damper, or any other component configured to bias the vertical linkage 110 to the vertical neutral position. In some embodiments, a vertical set of biasing elements 134 may be implemented to provide a force that pulls or pushes the vertical linkage 110 toward the vertical neutral position. For example, as shown in FIGS. 1-4, multiple biasing elements 134 may be coupled to the tilt arms 114 of the vertical linkage 110, with one or more on either side of the location where the vertical linkage 110 is coupled to the base 102. The vertical biasing elements 134 thus exert a force on the vertical linkage 110 toward the vertical neutral position when the vertical linkage 110 is out of the vertical neutral position, such as is shown in FIG. 6.

As will be apparent to a person of skill in the art, in the embodiment shown in FIGS. 1-4, the vertical motion of the left footplate 106 and the vertical motion of the right footplate 108 are reciprocally linked. In other words, when the left footplate 106 moves in a first direction, the right footplate 108 moves in a second direction opposite the first direction. The magnitude of the motions of the right footplate 108 and the left footplate 106 may be the same, while the directions are opposite. This linked motion is caused by the left footplate 106 and the right footplate 108 being coupled to the vertical linkage 110 through the horizontal linkage 112 at either endpoint 128 of the tilt arms 114. With respect to any specific tilt arm 114, when the endpoint 128 associated with the left footplate 106 moves in an upward direction, the endpoint 128 associated with the right footplate 108 moves in a downward direction. This causes the same motion to apply to the left footplate 106 and the right footplate 108.

The horizontal linkage 112 may be configured to control the horizontal motion of the left footplate 106 and the right footplate 108. As shown in FIGS. 1-4, in some embodiments, the horizontal linkage 112 comprises a plurality of swing arms 136 coupled to the vertical linkage 110. A left group 138 of the plurality of swing arms 136 may be coupled to the left footplate 106 at a free end 140 of each swing arm 136 and a right group 142 of the plurality of swing arms 136 may be coupled to the right footplate 108 at the free end 140 of each swing arm 136. In some embodiments, the plurality of swing arms 136 is pivotally coupled to the vertical linkage 110, as shown in FIGS. 1-4. In such an embodiment, the free ends 140 of the left group 138 of the swing arms 136 may be pivotally coupled to the left footplate 106 and the free ends 140 of the right group 142 of the swing arms 136 may be pivotally coupled to the right footplate 108. The swing arms 136 of the left group 138 may extend toward the swing arms 136 of the right group 142 and the sing arms 136 of the right group 142 may extend toward the swing arms 136 of the left group 138. The plurality of swing arms 136 may be configured to rotate about an axis perpendicular to the horizontal surface on which the base 102 sits. Thus, if the vertical linkage 110 does not cause a change in height of the left footplate 106 and the right footplate 108, as the swing arms 136 rotate, the free ends 140 of each swing arm 136 move parallel with the horizontal surface, causing the left footplate 106 and the right footplate 108 to also move parallel to the horizontal surface.

Figure 7:
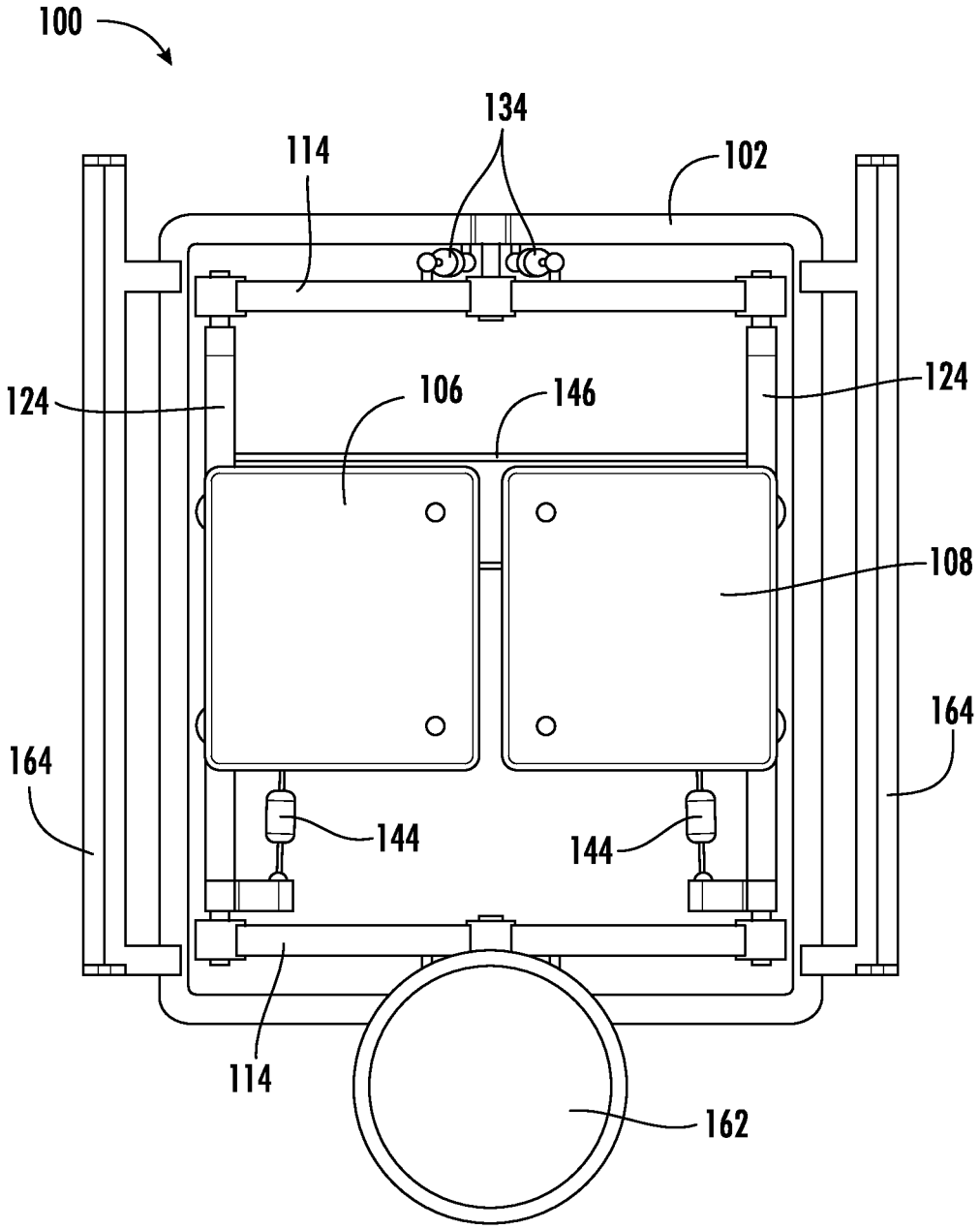
FIG. 7 is a top view of the body motion office work platform shown in FIG. 1 in the horizontal neutral position.
Figure 8:
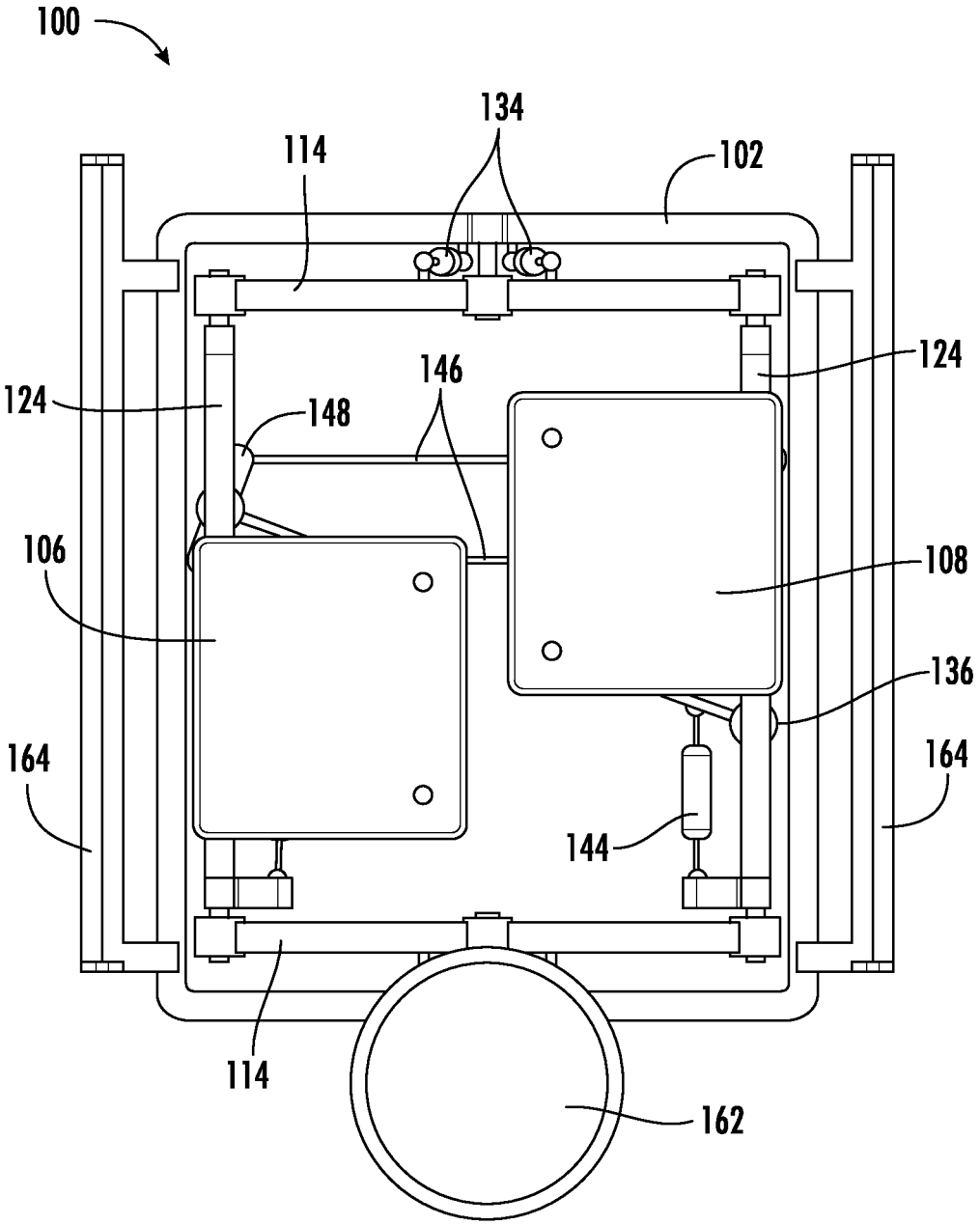
FIG. 8 is a top view of the body motion office work platform shown in FIG. 1 moved out of the horizontal neutral position.

The horizontal linkage 112 may be biased towards a horizontal neutral position. When the horizontal linkage 112 is in the horizontal neutral position, the left footplate 106 and the right footplate 108 are positioned equidistant from a plane extending upward from a front of the base 102, as shown in FIG. 7. In other words, the left footplate 106 and the right footplate 108 may be at the same position along an axis parallel with the right side 130 and the left side 132 of the base 102, assuming that the right side 130 and the left side 132 are both perpendicular to the front of the base 102. Thus, the left footplate 106 and the right footplate 108 may be horizontally self-centering. A horizontal biasing element 144 may be affixed to the horizontal linkage 112 and to the vertical linkage 110 to provide the bias towards the horizontal neutral position. The horizontal biasing element 144 may be a spring, a damper, or any other component configured to bias the horizontal linkage 112 to the horizontal neutral position. In some embodiments, a horizontal set of biasing elements 144 may be implemented to provide a force that pulls or pushes the horizontal linkage 112 toward the horizontal neutral position. For example, as shown in FIGS. 1-4, a biasing element 144 may be coupled to a swing arm 136 from the left group 138 and another biasing element 144 may be coupled to a swing arm 136 from the right group 142. The horizontal biasing elements 144 thus exert a force on the horizontal linkage 112 toward the horizontal neutral position when the horizontal linkage 112 is out of the horizontal neutral position, such as is shown in FIG. 8.

Because the horizontal motion of the left footplate 106 and the vertical motion of the left footplate 106 are controlled by linkages that are not operatively coupled to each other, these motions are independent of each other. Similarly, because the horizontal motion of the right footplate 108 and the vertical motion of the right footplate 108 are controlled by linkages that are not operatively coupled to each other, these motions are also independent of each other. Thus, the left footplate 106 can move horizontally independent of any vertical movement of the left footplate 106 and can move vertically independent of any horizontal movement of the left footplate 106. Similarly, the right footplate 108 can move horizontally independent of any vertical movement of the right footplate 108 and can move vertically independent of any horizontal movement of the right footplate 108.

The left group 138 of the swing arms 136 and the right group 142 of the swing arms 136 may be tied together by one or more tie rods 146. The tie rod 146 establishes a constant distance between a specific point on one of the swing arms 136 in the left group 138 and a specific point on one of the swing arms 136 in the right group 142. For example, a tab 148 may extend away from the pivot point of one of the swing arms 136 of the left group 138 and another tab 148 may extend away from the pivot point of one of the swing arms 136 of the right group 142, in the same direction as the tab 148 on the swing arm 136 of the left group 138. The tie rod 146 may join the tabs 148 on the swing arm 136 in the left group 138 and the swing arm 136 in the right group 142. Thus, when either the left footplate 106 or the right footplate 108 moves in a horizontal direction, the associated swing arm 136 rotates and causes the associated tab 148 to move toward or away from the joined tab 148 to which it is tied through the tie rod 146. This causes the joined tab 148 to move in the same direction, and thus causes the associated swing arm 136 to rotate in the same angular direction. In embodiments where the swing arms 136 of the left group 138 and the swing arms 136 of the right group 138 extend toward each other, rotating the swing arms 136 in the same angular direction causes the left footplate 106 and the right footplate 108 to move in opposite linear directions. Thus, the horizontal motion of the left footplate 106 may be reciprocally linked to the horizontal motion of the right footplate 108. In other words, when the left footplate 106 moves in a first direction, the right footplate 108 moves in a second direction opposite the first direction. The magnitude of the motions of the right footplate 108 and the left footplate 106 may be the same, while the direction is opposite. This helps the platform 100 to remain stable by keeping a center of gravity of the platform 100 in a center of the base 102.

Figure 10:
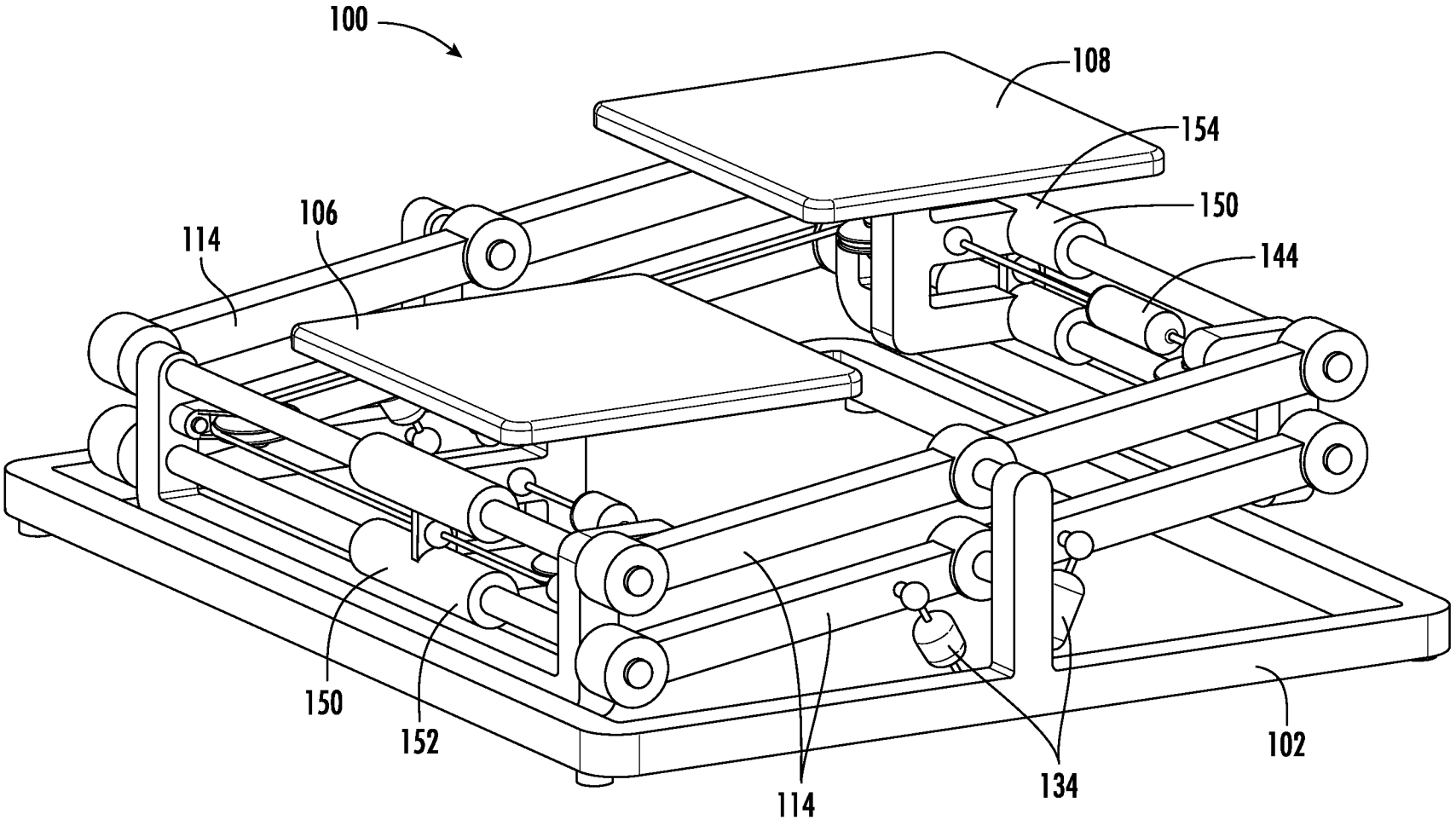
FIG. 10 is a perspective view of another embodiment of the body motion office work platform.
Figure 11:
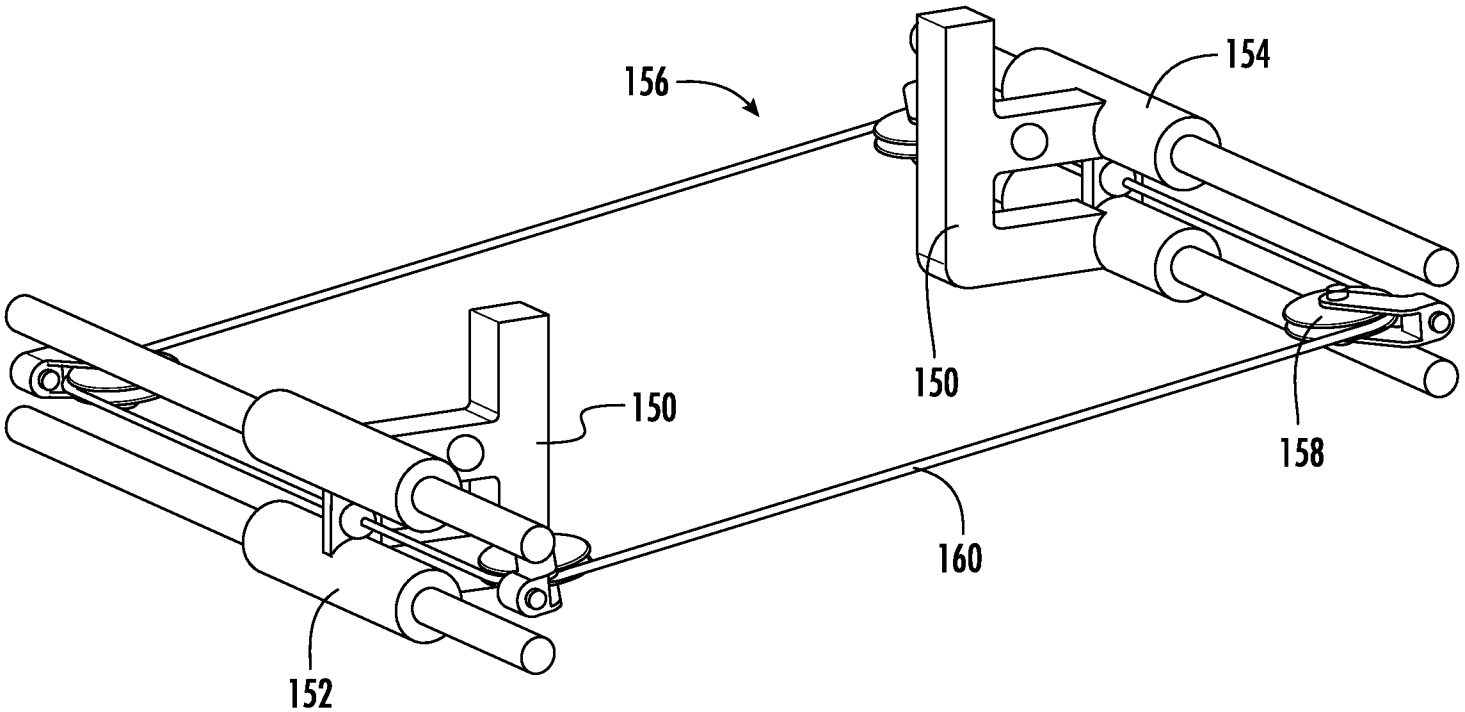
FIG. 11 is a perspective view of the horizontal linkage of the body motion office work platform shown in FIG. 10.

As illustrated in FIGS. 10-11, the swing arm 136 may be replaced by a linear motion stage 150. Thus, there may be a left linear motion stage 152 associated with the left footplate 106 and a right linear motion stage 154 associated with the right footplate 106. The linear motion stages 150 are slidingly coupled with the vertical linkage 110 to allow the left footplate 106 and the right footplate 108 to move within the horizontal plane. As with the other embodiments disclosed above, the horizontal linkage 112 may be biased towards the horizontal neutral position by coupling the linear motion stages 150 to the vertical linkage 110 with a horizontal biasing element 144 as described above. Additionally, similar to the tie rods 146 disclosed above, a system 156 of pulleys 158 and cables 160 may tie the left linear motion stage 152 to the right linear motion stage 154, as shown in FIG. 11. As will be apparent to one of skill in the art, motion transfer systems that function that same as pulleys and cables may be implemented as well, such as pulleys and belts or sprockets and chains, and are considered equivalents of the system 156 of pulleys 158 and cables 160 disclosed herein. When the left linear motion stage 152 moves in a first direction, the cable 160 pulls on the right linear motion stage 154. However, the pulleys 158 redirect the force so that the right linear motion stage 154 moves in a second direction opposite the first direction. Thus, the horizontal motion of the left footplate 106 and the horizontal motion of the right footplate 108 are reciprocally linked in this embodiment as well.

In embodiments where the horizontal motion of the left footplate 106 and the horizontal motion of the right footplate 108 are reciprocally linked, and/or in embodiments where the vertical motion of the left footplate 106 and the vertical motion of the right footplate 108 are reciprocally linked, this reciprocal linking of the motions of the footplates 106, 108 causes movement of each of the left footplate 106 and the right footplate 108 to require an equal and opposite force to be applied to the other footplate. This results in no net forces acting to reposition the user and removes the need for the user to grip handles or other objects to use the platform 100. This means that the user can operate the platform 100 hands-free, thus limiting disruptive forces that hinder the user's ability to perform normal desk work.

Figure 12:
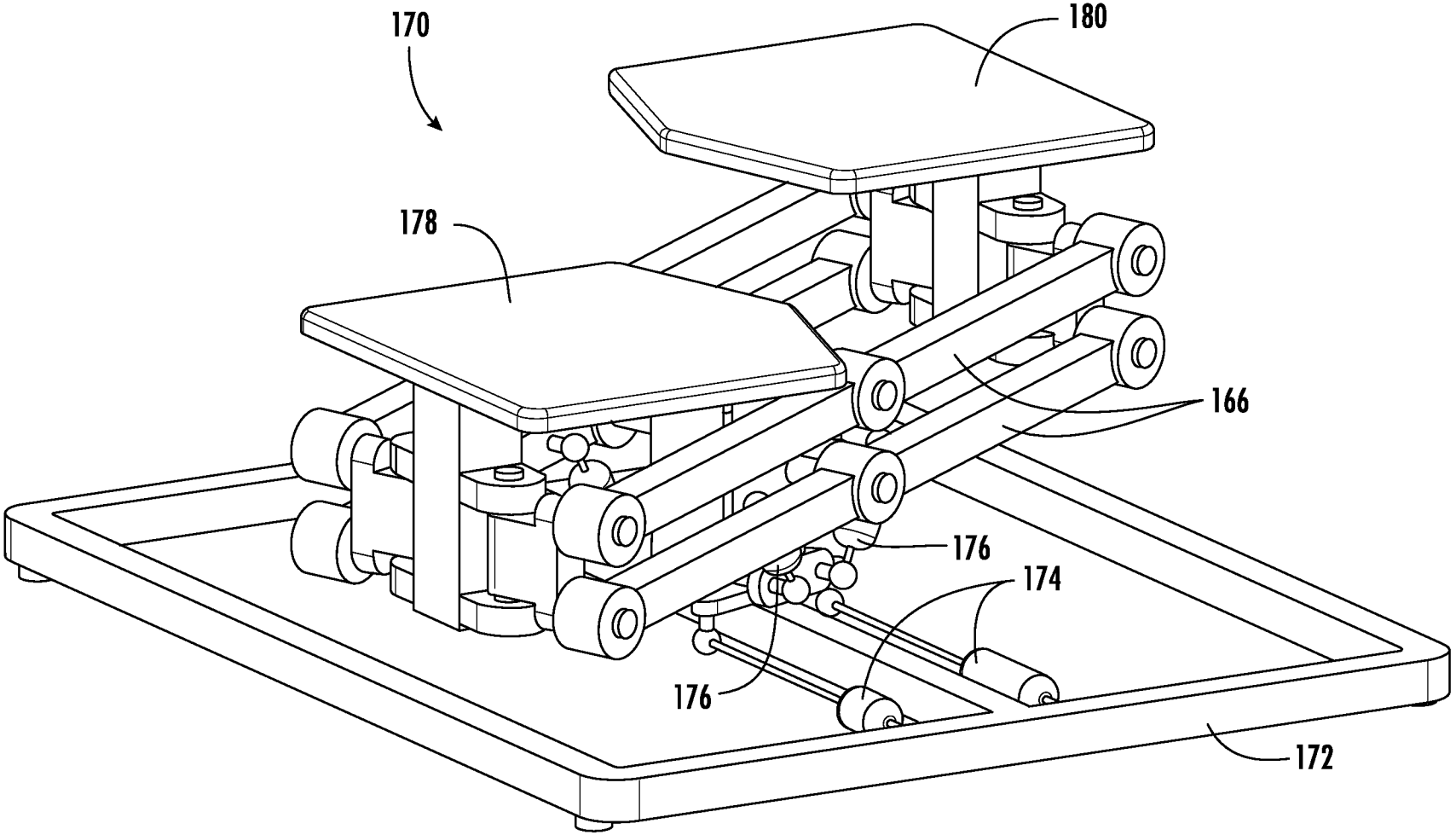
FIG. 12 is a perspective view of another embodiment of the body motion office work platform.
Figure 13:
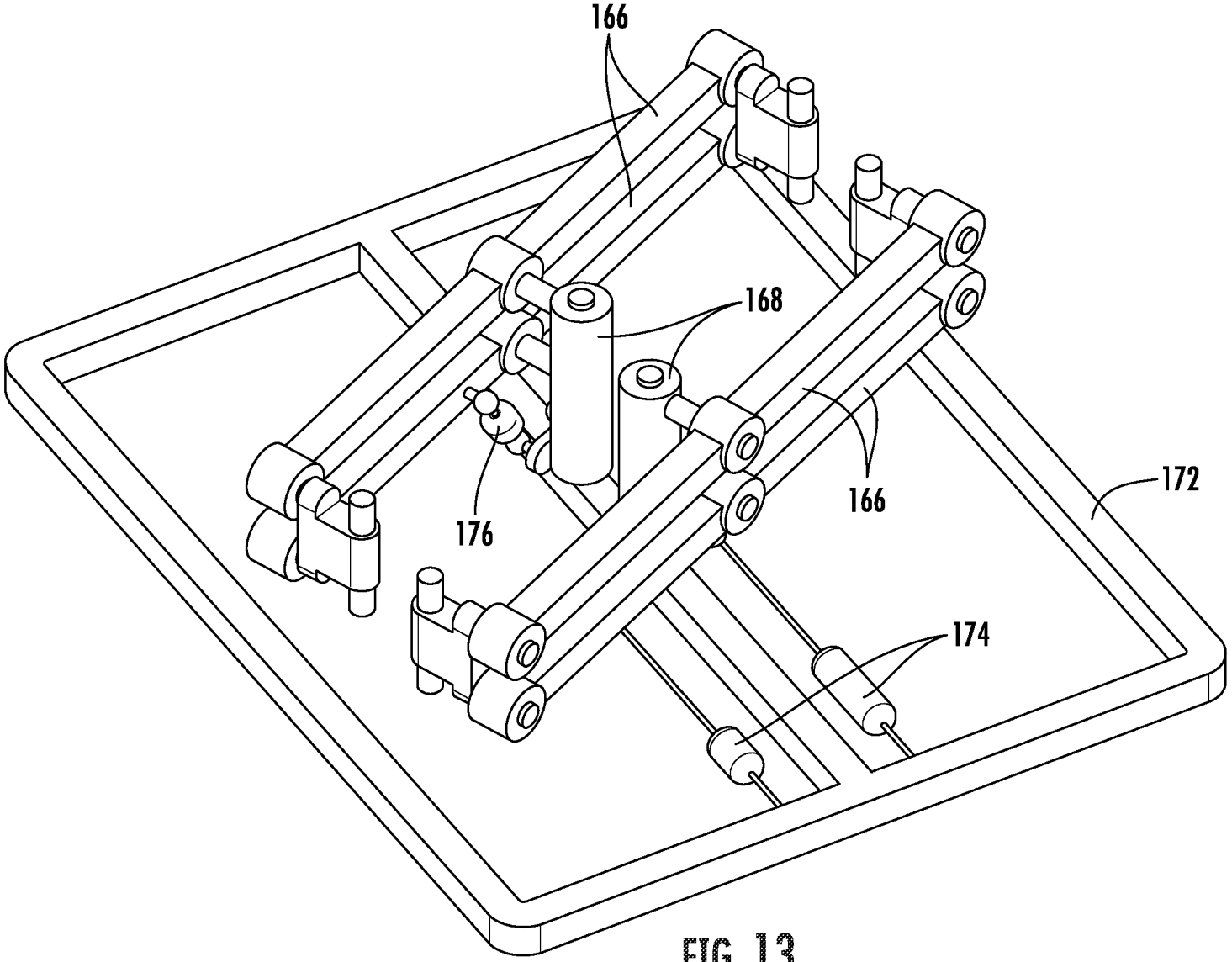
FIG. 13 is a perspective view of the base of the body motion office work platform shown in FIG. 12 supporting the vertical linkage and the horizontal linkage Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

In some embodiments, as illustrated in FIGS. 12-13, the order of the vertical linkage 110 and the horizontal linkage 112 may be switched. In such an embodiment, instead of the vertical linkage 110 being coupled to the base 102 and the horizontal linkage 112 being coupled to the left footplate 106 and the right footplate 108, the vertical linkage 166 is coupled to the left footplate 106 and the right footplate 108, and the horizontal linkage 168 is coupled to the base 102. In other words, the vertical linkage 110 and the horizontal linkage 112 may be switched in their positions in the progression of components from the base 102 to the left footplate 106 and the right footplate 108. Any of the other features described above in relation to the other embodiments may be implemented with this embodiment as well. For example, as shown in FIGS. 12-13, the platform 170 may comprise a horizontal linkage 168 that is rotatably coupled to a base 172 and is biased to a horizontal neutral position by the biasing elements 174, and a vertical linkage 166 that is rotatably coupled to the horizontal linkage 168 and is biased to a vertical neutral position by the biasing elements 176. The left footplate 178 and the right footplate 180 are coupled to the vertical linkage 166. Any other arrangement and/or combination of the components discussed above is also possible. For example, as mentioned above, some embodiments have only a vertical linkage 110, 166, while other embodiments have only a horizontal linkage 112, 168.

In some embodiments, the entire mechanism that enables motion of the left footplate 106 is contained below the plane of the top surface of the left footplate 106. Similarly, the entire mechanism that enables motion of the right footplate 108 is contained below the plane of the top surface of the right footplate 108. Similarly, when the left footplate 106 and the right footplate 108 are in an aligned position in which the left footplate 106 and the right footplate 108 are positioned equidistant from the horizontal surface on which the base 102 sits, as shown in FIG. 5, the plurality of mechanical linkages may be contained below the left footplate 106 and the right footplate 108. In other words, all of the plurality of mechanical linkages may be below the plane of the top surfaces of the left footplate 106 and the right footplate 108 when the left footplate 106 and the right footplate 108 are in the aligned position. This helps to avoid interference of the legs of the user or the legs of a desk above the platform 100 with the various components of the platform 100 because the footplates 106, 108 separate the user from the components of the platform 100.

Depending on the embodiment, the exact motion path of the left footplate 106 and the right footplate 108 varies. For example, in the embodiments disclosed herein, the footplates 106, 108 may move in parallel lines to each other, may arc slightly toward each other, or may arc slightly away from each other. However, in general the footplates 106, 108 move in a forward and backward motion, with little movement side to side, and in an upward and downward motion. Because these motions are independent as described above, they can be combined in any way. Thus, the left footplate 106 can move forward and upward simultaneously, forward and downward simultaneously, backward and upward simultaneously, or backward and downward simultaneously, and any of these combinations can be at any angle. This allows the user to move their limbs and joints to any position desired. The reciprocal motion of the other footplate helps to keep the platform 100 balanced and improves the safety of the user while using the platform 100.

As shown in FIG. 1, the platform 100 may also comprise a seat 162. The seat 162 provides a surface on which the user can sit while using platform. Specifically, the platform 100 may be used at a desk, such as while performing office work. Thus, the platform 100 may be used while standing or while sitting on the seat 162, depending on the current preferences of the user. The seat 162 may have an adjustable height. The platform 100 may also comprise side rails 164 that are configured to couple with a desk. In some embodiments, the side rails 164 are configured to couple with a height-adjustable desk.

It will be understood that implementations of a body motion platform are not limited to the specific assemblies, devices and components disclosed in this document, as virtually any assemblies, devices and components consistent with the intended operation of a body motion platform may be used. Accordingly, for example, although particular body motion platforms, and other assemblies, devices and components are disclosed, such may include any shape, size, style, type, model, version, class, measurement, concentration, material, weight, quantity, and/or the like consistent with the intended operation of body motion platforms. Implementations are not limited to uses of any specific assemblies, devices and components; provided that the assemblies, devices and components selected are consistent with the intended operation of a body motion platform.

Accordingly, the components defining any body motion platform may be formed of any of many different types of materials or combinations thereof that can readily be formed into shaped objects provided that the materials selected are consistent with the intended operation of a body motion platform. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various body motion platforms may be manufactured using conventional procedures as added to and improved upon through the procedures described here. Some components defining a body motion platform may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling body motion platforms are not limited to the specific order of steps as disclosed in this document. Any steps or sequence of steps of the assembly of a body motion platform indicated herein are given as examples of possible steps or sequence of steps and not as limitations, since various assembly processes and sequences of steps may be used to assemble body motion platforms.

The implementations of a body motion platform described are by way of example or explanation and not by way of limitation. Rather, any description relating to the foregoing is for the exemplary purposes of this disclosure, and implementations may also be used with similar results for a variety of other applications employing a body motion platform.

What is claimed is:

1. A body motion office work platform comprising:

a base configured to sit on a surface and stabilize the body motion office work platform;

a plurality of mechanical linkages coupled to the base including a horizontal linkage; and a left footplate and a right footplate each linked to the base through the plurality of mechanical linkages;

wherein the plurality of mechanical linkages is configured to move each of the left footplate and the right footplate through a horizontal motion and a vertical motion with respect to the base;

wherein the horizontal linkage is configured to control the horizontal motion of the left footplate and the right footplate and is biased towards a horizontal neutral position in which the left footplate and the right footplate are positioned equidistant from a plane extending upward from a front of the base; and wherein the horizontal motion of the left footplate is reciprocally linked to the horizontal motion of the right footplate.

2. The body motion office work platform of claim 1, wherein the horizontal motion and the vertical motion of the left footplate are independent of each other, and the horizontal motion and the vertical motion of the right footplate are independent of each other.

3. The body motion office work platform of claim 1, wherein the vertical motion of the left footplate is reciprocally linked to the vertical motion of the right footplate.

4. The body motion office work platform of claim 1, wherein the plurality of mechanical linkages further includes a vertical linkage configured to control the vertical motion of the left footplate and the right footplate and wherein the vertical linkage is biased towards a vertical neutral position in which the left footplate and the right footplate are positioned equidistant from the surface.

5. The body motion office work platform of claim 1, wherein, when the left footplate and the right footplate are in an aligned position in which the left footplate and the right footplate are positioned equidistant from the surface, the plurality of mechanical linkages is contained below the left footplate and the right footplate.

6. The body motion office work platform of claim 1, wherein the horizontal linkage is biased towards the horizontal neutral position by a horizontal set of biasing elements.

7. The body motion office work platform of claim 1, further comprising a seat adjustably coupled to the base and configured to allow a user to operate the body motion office work platform while seated.

8. The body motion office work platform of claim 1, wherein the left footplate and the right footplate are each sized to simultaneously fit both feet of a user.

9. A body motion office work platform comprising:

a base configured to sit on a surface and stabilize the body motion office work platform;

a plurality of mechanical linkages coupled to the base; and a left footplate and a right footplate each linked to the base through the plurality of mechanical linkages;

wherein the plurality of mechanical linkages is configured to move each of the left footplate and the right footplate through a horizontal motion and a vertical motion with respect to the base;

wherein the horizontal motion and the vertical motion of the left footplate are independent of each other, and the horizontal motion and the vertical motion of the right footplate are independent of each other; and wherein the horizontal motion of the left footplate is reciprocally linked to the horizontal motion of the right footplate and the vertical motion of the left footplate is reciprocally linked to the vertical motion of the right footplate.

10. The body motion office work platform of claim 9, wherein the plurality of mechanical linkages includes a vertical linkage configured to control the vertical motion of the left footplate and the right footplate and a horizontal linkage configured to control the horizontal motion of the left footplate and the right footplate.

11. The body motion office work platform of claim 10, wherein the vertical linkage is biased towards a vertical neutral position in which the left footplate and the right footplate are positioned equidistant from the surface and the horizontal linkage is biased towards a horizontal neutral position in which the left footplate and the right footplate are positioned equidistant from a plane extending up from a front of the base.

12. The body motion office work platform of claim 9, further comprising a seat adjustably coupled to the base and configured to allow a user to operate the body motion office work platform while seated.

13. The body motion office work platform of claim 9, wherein the left footplate and the right footplate are each sized to simultaneously fit both feet of a user.

14. A body motion office work platform comprising:

a base configured to sit on a surface and stabilize the body motion office work platform;

a plurality of mechanical linkages coupled to the base; and a left footplate and a right footplate each linked to the base through the plurality of mechanical linkages;

wherein the plurality of mechanical linkages includes a horizontal linkage comprising a plurality of left swing arms and a plurality of right swing arms, the plurality of left swing arms coupled to the left footplate at a free end of each left swing arm and the plurality of right swing arms coupled to the right footplate at a free end of each right swing arm;

wherein the left footplate and the right footplate are each sized to simultaneously fit both feet of a user; and wherein the plurality of mechanical linkages is configured to move each of the left footplate and the right footplate with respect to the base, wherein the movement is substantially parallel with the surface.

15. The body motion office work platform of claim 14, wherein, when the left footplate and the right footplate are in an aligned position in which the left footplate and the right footplate are positioned equidistant from the surface, the plurality of mechanical linkages is contained below the left footplate and the right footplate.

16. The body motion office work platform of claim 14, wherein the plurality of mechanical linkages includes the horizontal linkage configured to control the movement of the left footplate and the right footplate and wherein the horizontal linkage is biased towards a horizontal neutral position in which the left footplate and the right footplate are positioned equidistant from a plane extending up from a front of the base.

17. The body motion office work platform of claim 14, further comprising a seat adjustably coupled to the base and configured to allow a user to operate the body motion office work platform while seated.

18. The body motion office work platform of claim 14, wherein the movement of the left footplate is reciprocally linked to the movement of the right footplate.

* * * * *